US008616847B2

(12) United States Patent
Allen

(10) Patent No.: US 8,616,847 B2
(45) Date of Patent: Dec. 31, 2013

(54) ABRASIVE COATED PREFORM FOR A TURBINE BLADE TIP

(75) Inventor: David B. Allen, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 686 days.

(21) Appl. No.: 12/870,997

(22) Filed: Aug. 30, 2010

(65) Prior Publication Data

US 2012/0051934 A1 Mar. 1, 2012

(51) Int. Cl.
*F01D 5/08* (2006.01)

(52) U.S. Cl.
USPC ..... 416/92; 416/224; 416/228; 416/241 R; 416/241 B; 415/115; 415/173.4; 415/173.6; 415/200; 29/889.1

(58) Field of Classification Search
USPC ..... 415/115, 173.4, 173.6, 200; 416/92, 416/224, 228, 241 R, 241 B; 29/889.1
See application file for complete search history.

(56) References Cited

U.S. PATENT DOCUMENTS

| | | | | | |
|---|---|---|---|---|---|
| 4,169,020 | A * | 9/1979 | Stalker et al. | 416/92 |
| 4,390,320 | A * | 6/1983 | Eiswerth | 416/92 |
| 4,411,597 | A * | 10/1983 | Koffel et al. | 416/92 |
| 4,802,828 | A * | 2/1989 | Rutz et al. | 416/241 B |
| 4,842,953 | A * | 6/1989 | Perkins et al. | 416/241 R |
| 5,264,011 | A * | 11/1993 | Brown et al. | 416/241 B |
| 5,620,489 | A * | 4/1997 | Tselesin | 51/293 |
| 5,622,638 | A * | 4/1997 | Schell et al. | 219/121.64 |
| 6,558,119 | B2 * | 5/2003 | Lee et al. | 416/97 R |
| 6,908,288 | B2 * | 6/2005 | Jackson et al. | 416/224 |

* cited by examiner

*Primary Examiner* — Igor Kershteyn

(57) ABSTRACT

A squealer tip preform having a coating including an abrasive is disclosed. The squealer tip may be separately formed from a generally elongated blade to which the squealer tip preform is configured to be attached. The squealer tip may be configured such that an outer surface of the squealer tip preform is generally aligned with an outer side surface of the turbine blade defining a cross-sectional profile of the turbine blade. Forming the squealer tip preform with an abrasive coating separate from the turbine blade greatly reduces costs and improves efficiency as compared with conventional systems.

18 Claims, 2 Drawing Sheets

ABRASIVE COATED PREFORM FOR A TURBINE BLADE TIP

FIELD OF THE INVENTION

This invention is directed generally to turbine blades, and more particularly to airfoil tips for turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The tip of a turbine blade often has a tip feature to reduce the gap between ring segments and blades in the gas path of the turbine. The tip features are often referred to as squealer tips and are frequently incorporated onto the tips of blades to help reduce pressure losses between turbine stages. These features are designed to minimize the gap between the blade tip and the ring segment.

SUMMARY OF THE INVENTION

A squealer tip preform having a coating including an abrasive is disclosed. The squealer tip preform may be separately formed as a component to be attached to a generally elongated blade. The squealer tip preform may be configured such that an outer surface of the squealer tip preform is generally aligned with an outer side surface of the turbine blade defining a cross-sectional profile of the turbine blade. Forming the squealer tip preform with an abrasive coating separate from the turbine blade can reduce manufacturing costs and process times as compared with conventional systems.

The squealer tip may be attached to a turbine blade. The turbine blade may be formed from a generally elongated blade having a leading edge, a trailing edge, and a tip at a first end, a root coupled to the blade at an end generally opposite the first end for supporting the blade and root features for coupling the blade to a disc. The squealer tip preform may be coupled, such as by being secured or bonded, to the tip of the blade at the first end. The squealer tip may be coated with a coating that includes at least one abrasive, and the squealer tip may be formed separately from the generally elongated blade. The squealer tip may be configured such that an outer surface of the squealer tip preform is generally aligned with an outer side surface of the turbine blade defining a cross-sectional profile of the turbine blade. The squealer tip preform may have a thickness of between about 0.4 millimeter and 1.0 millimeter. In another embodiment, the squealer tip preform may have a thickness of about 0.5 millimeter. This thickness may be optimized for rigidity and dimensional stability of the preform as well as to reduce the risk of FOD/DOD if it should separate from the turbine blade during operation.

The squealer tip preform may include an abrasive such as, but not limited to, a cubic boron nitride or silicon carbide embedded in a nickel/CoNiCrAlY matrix. The abrasive embedded in the nickel/CoNiCrAlY matrix may be attached to the tip of the squealer tip preform via electroplating. The squealer tip preform may also be attached to the tip of the turbine blade via brazing.

The squealer tip preform may be manufactured by forming a squealer tip preform having a footprint less than a cross-sectional area of a tip of a turbine blade to which the preform is configured to be attached. Forming the squealer tip preform may also include forming the squealer tip preform with a thickness between about 0.4 millimeter and about 1.0 millimeter, and in one embodiment, forming the squealer tip preform with a thickness of about 0.5 millimeter. The blade tip and preform may be manufactured with mating features such as a pin and hole, or mating slot system to allow for more accurate positioning and retention of the preform on the blade during welding or brazing.

The method may include electroplating the squealer tip preform with abrasive grains mixed with a nickel and CoNiCrAlY matrix. The method may also include applying a diffusion heat treatment to increase the density and diffuse the metal coating around the abrasive grains. The method may include attaching the squealer tip to a turbine blade tip and in one embodiment, attaching the squealer tip to a turbine blade tip comprises attaching the squealer tip via brazing.

The squealer tip preform may be a component configured to be attached to a radially outward tip of the turbine blade usable in a turbine engine, whereby the squealer tip may be configured such that an outer surface of the squealer tip preform is generally aligned with an outer side surface of the turbine blade defining a cross-sectional profile of the turbine blade. The squealer tip preform may include one or more of the elements set forth herein.

An advantage of this invention is that by separately manufacturing the squealer tip preform as an individual component separated from the turbine blade, the squealer tip preform may be coated individually without having to account for the turbine blade, thereby resulting in savings because may preforms may be coated at one time in a given tank. In particular, a particular coating may be applied in a single application in the same system to hundreds of squealer tip preforms rather than to only a couple of tips of turbine blades at one time in a single batch because the squealer tips take up so much less room than a single turbine blade. As such, a single batch would coat hundreds of squealer tip preforms in comparison to a single batch of a couple of turbine blades. Thus, a significant cost savings is realized by using a squealer tip preform.

Another advantage of this invention is that the squealer tip preforms may be created at a single location and more easily distributed from there than handling and working with an entire turbine blade.

Yet another advantage is that the abrasive coated preforms may allow fitment of abrasive tips to service run blades in either a field repair or at scheduled service intervals.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
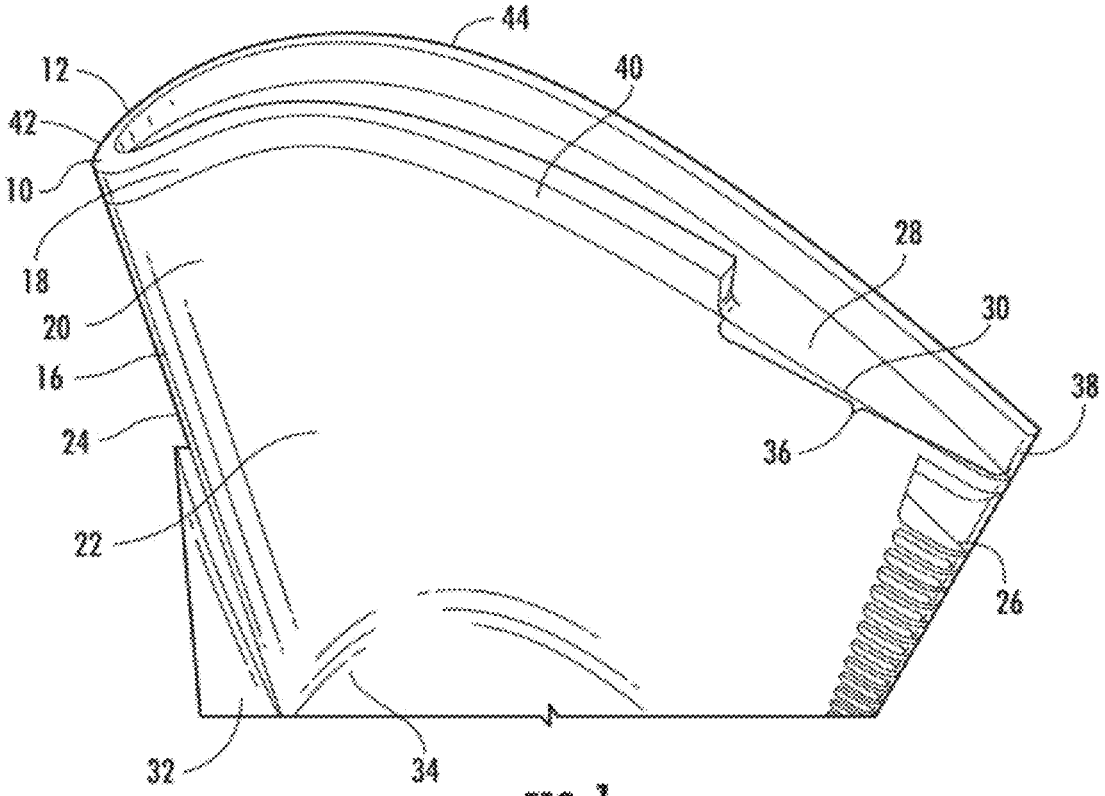
FIG. 1 is a perspective view of a turbine blade with a squealer tip preform attached thereto.

As shown in FIGS. 1-4, a squealer tip preform 10 having a coating 12 including an abrasive 14 is disclosed. The squealer tip preform 10 may be separately formed from a generally elongated blade 22 to which the squealer tip preform 10 is configured to be attached. The squealer tip preform 10 may be configured such that an outer surface 18 of the squealer tip preform 10 is generally aligned with an outer side surface 20 of the turbine blade 16 defining a cross-sectional profile of the turbine blade 16. Forming the squealer tip preform 10 with an abrasive coating 12 separate from the turbine blade 16 greatly reduces costs and improves efficiency as compared with conventional systems.

The squealer tip preform 10 may be attached to a radially outward tip 14 of a turbine blade 10. The turbine blade 16 may be formed from a generally elongated blade 22 having a leading edge 24, a trailing edge 26, a tip 28 at a first end 30, and a root 32 coupled to the blade 16 at an end 34 generally opposite the first end 30 for supporting the blade 16 and for coupling the blade 16 to a disc.

Figure 4:
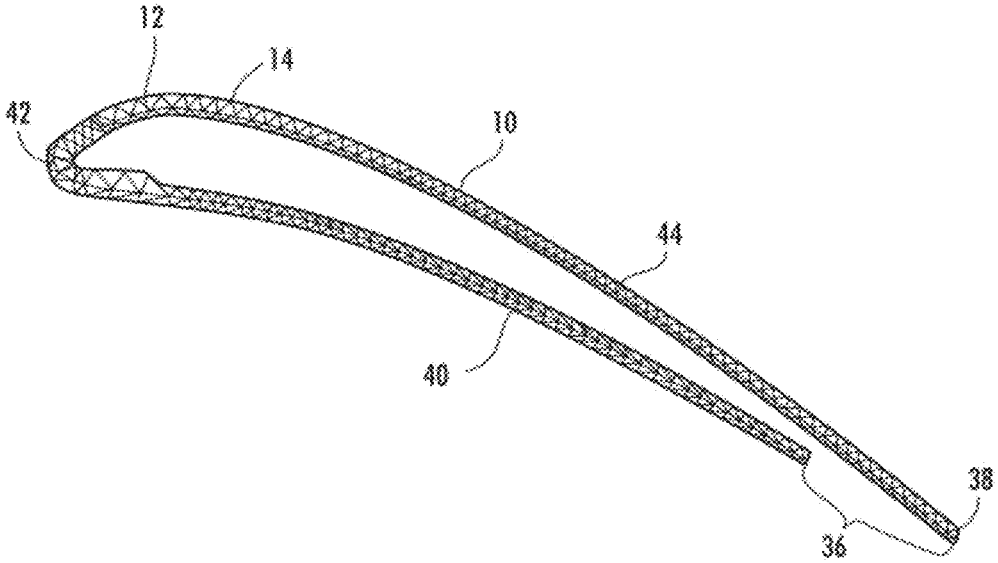
FIG. 4 is a perspective view of the squealer tip preform.

The squealer tip preform 10 may be coupled to the tip 28 at the first end 30. The squealer tip preform 10 may be configured such that an outer surface 18 of the squealer tip preform is generally aligned with an outer side surface 20 of the turbine blade defining a cross-sectional profile of the turbine blade 16. In particular, the squealer tip preform 10 may be configured such that the outer surface 18 of the squealer tip preform 10 does not extend beyond the outer side surface 20 of the turbine blade 16. As shown in FIG. 4, the squealer tip preform 10 may be configured to follow the outline of a turbine blade 16 to which the squealer tip preform 10 is to be attached. In addition, the squealer tip preform 10 may only extend for a portion of the distance around the perimeter of the turbine blade tip 28. In particular, the squealer tip preform 10 may include a gap 36 proximate to a trailing edge 38 on the pressure side 40. The squealer tip preform 10 may have a leading edge 42 opposite to the trailing edge 38 and a suction side 44 opposite to the pressure side 40. The pressure side 40 may be generally concave, and the suction side 44 may be generally convex. The leading edge 42 may be rounded and larger than the trailing edge 38. The midchord region may taper in an ever reducing thickness to the trailing edge 38.

The squealer tip preform 10 may be formed with a thickness such that the thickness is reduced to minimize the mass of the preform 10 in the event that the preform 10 were to debond from the blade tip 28 and become a projectile in the turbine engine. In addition, it is desirable to have some degree of thickness to retain dimensional accuracy after coating and diffusion treatment because the braze process cannot reliably fill large gaps. Thus, the squealer tip preform 10 may have a thickness of between about 0.4 millimeter and 1.0 millimeter. In one embodiment, the squealer tip preform 10 may have a thickness of about 0.5 millimeter. The squealer tip preform 10 may be formed from any appropriate material including the parent metal of the blade tip or may be produced from a different material having increased hardness or toughness from the parent blade metal.

Figure 2:
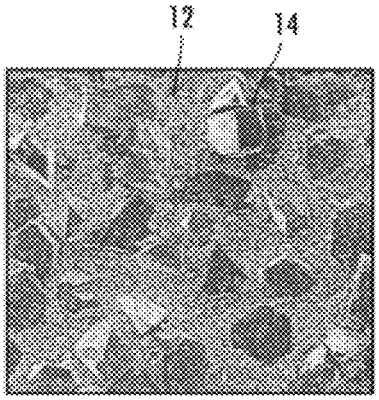
FIG. 2 is a detailed view of the abrasive coating on the squealer tip preform in FIG. 1.
Figure 3:
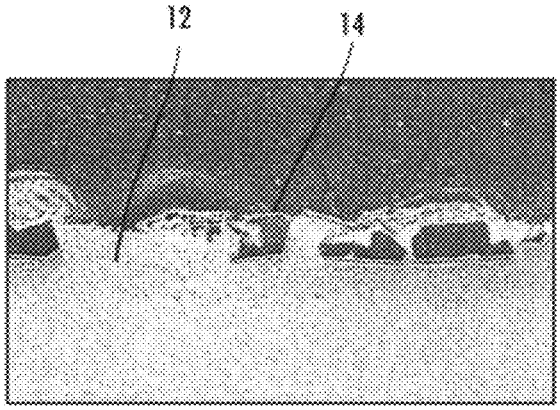
FIG. 3 is another detailed view of the abrasive coating on the squealer tip preform in FIG. 1.

The squealer tip preform 10 may be coated with a coating 12 that includes one or more abrasives 14, as shown in FIGS. 2 and 3. In at least one embodiment, the coating 12 may be, but is not limited to, a nickel/CoNiCrAlY matrix. In another embodiment, the abrasives 14 may be, but are not limited to being, cubic boron nitride grains and silicon carbide. The cubic boron nitride grains may be embedded in the nickel/CoNiCrAlY matrix. The cubic boron nitride embedded in the nickel/CoNiCrAlY matrix may be attached to the tip of the squealer tip preform 10 via electroplating.

The squealer tip preform 10 may be attached to the tip 28 of the turbine blade 16 in any appropriate manner. In at least one embodiment, the squealer tip preform 10 may be attached via brazing or other appropriate method.

The squealer tip preform 10 may be formed with a method of manufacturing a squealer tip preform 10 for a turbine blade 16. The method may include forming a squealer tip preform 10 having a footprint less than a cross-sectional area of a tip 28 of a turbine blade 16 to which the preform 10 is configured to be attached. The method of forming the squealer tip preform 10 may include forming the squealer tip preform 10 with a thickness between about 0.4 millimeter and about 1.0 millimeter. In particular, the squealer tip preform 10 may include forming the squealer tip preform 10 with a thickness of about 0.5 millimeter.

The method may include electroplating the squealer tip preform 10 with abrasive grains mixed with a nickel and CoNiCrAlY matrix. The method may also include applying a diffusion heat treatment to increase the density and diffuse the metal coating around the abrasive grains. Once the squealer tip preform 10 has been formed, the preform may be attached to a turbine blade tip 28. The squealer tip preform 10 may be attached to the turbine blade tip 28 comprises attaching the squealer tip preform 10 via brazing.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a tip at a first end, and a root coupled to the blade at an end generally opposite the first end for supporting the blade and for coupling the blade to a disc; and a squealer tip preform coupled to the tip at the first end, wherein the squealer tip is coated with a coating that includes at least one abrasive and wherein the squealer tip is formed separately from the generally elongated blade and wherein the squealer tip is configured such that an outer surface of the squealer tip preform is generally aligned with an outer side surface of the turbine blade defining a cross-sectional profile of the turbine blade;

wherein the squealer tip preform includes a cubic boron nitride embedded in a nickel/CoNiCrAlY matrix.

2. The turbine blade of claim 1, wherein the cubic boron nitride embedded in the nickel/CoNiCrAlY matrix is attached to the tip of the squealer tip preform via electroplating.

3. The turbine blade of claim 1, wherein the squealer tip preform has a thickness of between about 0.4 millimeter and 1.0 millimeter.

4. The turbine blade of claim 1, wherein the squealer tip preform has a thickness of about 0.5 millimeter.

5. The turbine blade of claim 1, wherein the squealer tip preform is attached to the tip of the turbine blade via brazing.

6. A method of manufacturing a squealer tip preform for a turbine blade, comprising:

forming a squealer tip preform having a footprint less than a cross-sectional area of a tip of a turbine blade to which the preform is configured to be attached;

electroplating the squealer tip preform with cubic boron nitride abrasive grains mixed with a nickel and CoNiCrAlY matrix.

7. The method of claim 6, further comprising applying a diffusion heat treatment to increase the density and diffuse the metal coating around the abrasive grains.

8. The method of claim 6, further comprising attaching the squealer tip to a turbine blade tip.

9. The method of claim 6, wherein attaching the squealer tip to a turbine blade tip comprises attaching the squealer tip via brazing.

10. The method of claim 6, wherein forming the squealer tip preform further comprises forming the squealer tip preform with a thickness between about 0.4 millimeter and about 1.0 millimeter.

11. The method of claim 10, wherein forming the squealer tip preform further comprises forming the squealer tip preform with a thickness of about 0.5 millimeter.

12. A component for a turbine blade, comprising:

a squealer tip preform configured to be attached to a radially outward tip of the turbine blade usable in a turbine engine, wherein the squealer tip is configured such that an outer surface of the squealer tip preform is generally aligned with an outer side surface of the turbine blade defining a cross-sectional profile of the turbine blade; and wherein the squealer tip preform is coated with a coating that includes at least one abrasive and wherein the squealer tip is formed separately from a generally elongated blade;

wherein the squealer tip preform includes cubic boron nitride abrasive particles embedded in a nickel/CoNiCrAlY matrix.

13. The component of claim 12, wherein the squealer tip is configured such that an outer surface of the squealer tip preform does not extend beyond the outer side surface of the turbine blade.

14. The component of claim 12, wherein the squealer tip is attached to a generally elongated blade having a leading edge, a trailing edge, a tip at a first end, and a root coupled to the blade at an end generally opposite the first end for supporting the blade and for coupling the blade to a disc.

15. The component of claim 14, wherein the squealer tip preform is attached to the tip of the turbine blade via brazing.

16. The component of claim 12, wherein the cubic boron nitride embedded in the nickel/CoNiCrAlY matrix is attached to the tip of the squealer tip preform via electroplating.

17. The component of claim 12, wherein the squealer tip preform has a thickness of between about 0.4 millimeter and 1.0 millimeter.

18. The component of claim 17, wherein the squealer tip preform has a thickness of about 0.5 millimeter.

* * * * *